United States Patent [19]

Cordery

[11] Patent Number: 5,010,320

[45] Date of Patent: Apr. 23, 1991

[54] SELF MODULATING ELECTRONIC ARTICLE SURVEILLANCE MARKER

[75] Inventor: Robert A. Cordery, Danbury, Conn.

[73] Assignee: Pitney Bowes Inc., Stamford, Conn.

[21] Appl. No.: 448,183

[22] Filed: Dec. 8, 1989

[51] Int. Cl.[5] ..... G08B 13/24

[52] U.S. Cl. ..... 340/551; 340/572

[58] Field of Search ..... 340/551, 572

[56] References Cited

U.S. PATENT DOCUMENTS 4,510,490 4/1985 Anderson, III et al. ..... 340/572
4,622,543 11/1986 Anderson, III et al. ..... 340/572
4,660,025 4/1987 Humphrey ..... 340/572
4,710,752 12/1987 Cordery ..... 340/551
4,797,658 1/1989 Humphrey ..... 340/551

*Primary Examiner*—Glen R. Swann, III
*Assistant Examiner*—Thomas J. Mullen, Jr.
*Attorney, Agent, or Firm*—Peter Vrahotes; Melvin J. Scolnick; David E. Pitchenik

[57] ABSTRACT

A marker for an electronic surveillance system includes an element of a magnetostrictive material, and a non-magnetostrictive element of substantially the same size as said magnetostrictive element and firmly affixed thereto.

10 Claims, 1 Drawing Sheet

SELF MODULATING ELECTRONIC ARTICLE SURVEILLANCE MARKER

BACKGROUND OF THE INVENTION

This invention relates to electronic surveillance systems, and more in particular to an improved marker for use in such systems.

Electronic surveillance systems of the type to which the present invention is directed, are generally employed to detect the presence of a magnetic marker in a magnetic field. Such systems thus include a device for generating a magnetic field, and a receiver for detecting variations in the field resulting from passing of a marker, generally carried by an article, through the field.

Magnetic markers for electronic surveillance systems are disclosed in detail, for example, in U.S. Pat. Nos. 4,510,489 and 4,510,490 Anderson et al, wherein the marker is comprised of at least one strip of a ferromagnetic material. In order to produce a resonant signal from the marker, the marker is of a magnetostrictive material. A magnetic bias is applied to the magetostrictive strip by positioning the strip in the magnetic field of at least one magnet of a high coercivity material.

SUMMARY OF THE INVENTION

The present invention is directed to the provision of an improved magnetic marker for systems of magnetostrictive type, wherein the detectable characteristics of the marker are enhanced in a simple and economical manner.

Briefly stated, in accordance with one embodiment of the invention, a marker for an electronic surveillance marker includes a magnetostrictive element, such as a ribbon, adapted to experience a dimensional change in a first direction in the presence of a magnetic field. A second element, which may also be a ribbon, is firmly affixed to the magnetostrictive element. The second element is of a substantially non-magnetostrictive material, whereby the combined elements bend in the presence of a magnetic field. The bending varies the susceptibility of the first element, to change the signal output from the magnetostrictive element.

The first and second elements of the electronic surveillance marker of the invention may be strip shaped, and preferably have somewhat longer-length than width. The second element may be a biasing element for the first element, and may be glued to the first element. The second element is preferably of a material having a speed of sound substantially the same as the material of the first element.

In accordance with a further feature, the invention provides an electronic surveillance system comprising a marker, a source of a varying magnetic field, and a detector. The marker is adapted to be positioned in field and comprises a sandwich of a first layer of a magnetostrictive material and a second layer of a substantially non-magnetostrictive material firmly affixed thereto. The sandwich consequently bends in the presence of a magnetic field. The magnetic susceptibility of the magnetostrictive material is modified by the stress due to this bending. The frequency of the applied magnetic field is set equal to the longitudinal acoustic resonance frequency of the metallic sandwich. The bending of the sandwich produces modulation of the susceptibility, and thus modulation of the signal produced by the tag. The detector comprises means for detecting signals generated by bending of the sandwich. The second layer may comprise a magnet for biasing the first layer.

The detector of the electronic surveillance system may comprise circuit similar to an AM radio receiver in order to detect the amplitude modulation signal produced by the tag. In conventional systems employing a magnetostrictive tag, the tag has an acoustic resonance that is detected by first producing sinusoidal magnetic field, then shutting the field off and monitoring the voltage induced by ringing of the tag. The tag of the present invention, however, will produce a modulated signal when driven with a constant sine wave, so that it is not necessary to deenergize the field prior to detection. Accordingly, the invention provides a unique signal for detection.

BRIEF DESCRIPTION OF THE DRAWING

In order that the invention may be more clearly understood, it will now be disclosed in greater detail with reference to the accompanying drawing, wherein.

DETAILED DISCLOSURE OF THE INVENTION

Figure 1:
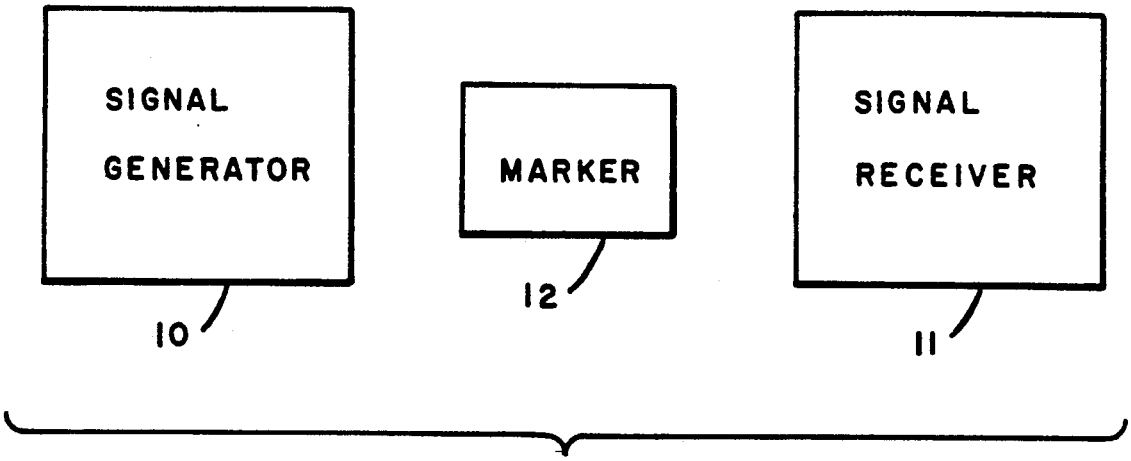
FIG. 1 is a block diagram of an electronic surveillance system of a type in which the marker of the invention may employed.

FIG. 1 is a simplified block diagram of an electronic surveillance system of the type that may employ the magnetic marker of the invention. In this system, a signal generator 10 and a signal receiver 11 are spaced apart, a distance such that a magnetic marker 12, may pass therebetween and influence the field detected by the receiver. The signal generator 10 may be comprised, for example, of a loop antenna coupled to a source of alternating energy, preferably but not necessarily shielded in order to remove the electrostatic field. The energy source preferably sweeps a frequency range around the designed acoustic resonance frequency of the tag. The frequency of the energy in the magnetic field may be 20–120 kHz, and it may have an amplitude of less than one Oersted.

The signal receiver 11 may also be comprised of a shielded loop antenna which optionally may be shielded, and this antenna may be connected to, for example, an AM receiver tuned to the swept frequency of the transmitter.

The marker 11, as will be discussed, is formed of a magnetostrictive material, and may be incorporated in or affixed to an article whose passage through the magnetic field is to be detected.

Figure 2:
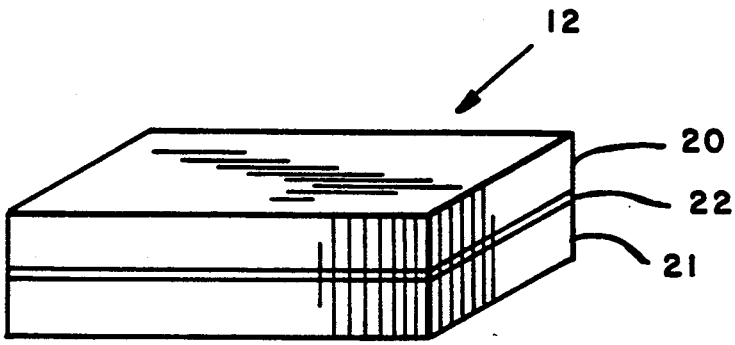
FIG. 2 is a perspective view of a marker for an electronic surveillance system in accordance with the invention.

Referring now to FIG. 2, the first element of the marker of the invention is a magnetostrictive strip or ribbon 20. This strip changes length when an external field is applied. The strip resonates if driven at the frequency of the acoustic length mode of the material. This frequency $f_a$ is defined as:

$$\text{pi } f_a = c/2l$$

where c is the speed of sound in the material of the strip and l is the length of the strip. The sweep frequency of the signal generator hence include the frequency $f_a$ within its range.

The second element of the marker is a strip or ribbon 21 of preferably the same length and width as the magnetostrictive strip, and of a material with substantially the same speed of sound. The second element 21, however, is not magnetostrictive. This second element 21 may be a magnet, to comprise a biasing source for the magnetostrictive strip 20.

The two elements are affixed together by any conventional means, for example by gluing them together with a thin layer 22 of glue.

Figure 3:
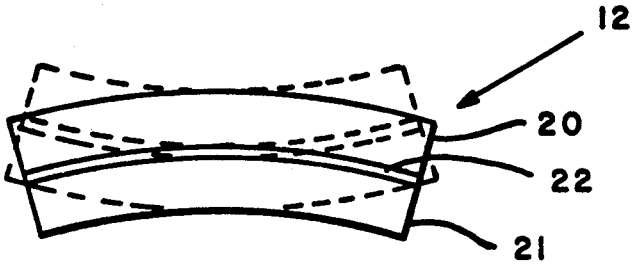
FIG. 3 is a view of the marker of FIG. 2, illustrating the bending thereof in a magnetic field.

In operation, when the marker is passed in the magnetic field of the signal generator 10, field components at the acoustic frequency $f_a$ cause the length of the magnetostrictive element 20 to change length. Since the non-magnetostrictive element 21 does not change length in this manner, the marker bends, as illustrated in FIG. 3, between the solid line position and the dashed line position, the bending occurring at a bending frequency dependent upon the mechanical characteristics of the structure. Due to the magnetostrictive effect, the strain induced by the bending changes the magnetic susceptibility of the magnetostrictive element. This change in susceptibility in turn changes the flux in the magnetostrictive component, causing a feed back effect. In other words, the flux of the field causes a change in length, and hence bending, of the marker. This bending in turn causes a change in susceptibility which produces a variation of the flux in the magnetostrictive component, thereby causing a further change in the length of the magnetostrictive component, etc. The resultant signal from the marker, which is centered about the resonant frequency $f_a$, is modulated by the bending mode frequency of the combined structure. This signal can be detected by conventional AM radio detection techniques.

The non-magnetostrictive element may comprise a permanent magnet of a high coercivity material, for biasing the magnetostrictive element. The magnetism of the permanent magnet may be cancelled, by passing the marker through a high intensity alternating magnetic field, to thereby reduce the ability of the marker to generate a readily detectable signal.

In accordance with the invention, the sandwich of the magnetostrictive element and non-magnetostrictive element produces a unique modulated signal in response to an applied field at the frequency $f_a$, and detection of the signal is simplified since the signal generated by the marker is amplitude modulated at the bending mode frequency.

While the invention has been disclosed and described with reference to a single embodiment, it will be apparent that variations and modification may be made therein, and it is therefore intended in the following claims to cover each such variation and modification as falls within the true spirit and scope of the invention.

What is claimed is:

1. In an electronic surveillance marker that includes a magnetostrictive first element adapted to experience a dimensional change in a first direction in the presence of a magnetic field, the improvement comprising a second element firmly affixed to said first element, said second element being of a substantially non-magnetostrictive material, whereby said first element bends in the presence of a magnetic field and said bending varies the susceptibility of said first element.

2. The electronic surveillance marker of claim 1 wherein said first and second elements are strip shaped.

3. The electronic surveillance marker of claim 2 wherein said elements have lengths that are longer than their widths.

4. The electronic surveillance marker of claim 3 wherein said second element comprises a biasing magnet.

5. The electronic surveillance marker of claim 3 wherein said second element is glued to said first element.

6. The electronic surveillance marker of claim 1 wherein said second element is of a material having a speed of sound substantially the same as the material of the first element.

7. The electronic surveillance marker of claim 1 wherein said first element is of a ferromagnetic material.

8. An electronic surveillance system comprising a marker, a source of a varying magnetic field, and a detector, said marker being adapted to be positioned in said field and comprising a sandwich of a first layer of a magnetostrictive material and a second layer of a substantially non-magnetostrictive material firmly affixed thereto, whereby said sandwich bends in the presence of a magnetic field, said detector comprising means for detecting signals generated by bending of said sandwich.

9. The electronic surveillance system of claim 8 wherein said detector comprises an AM radio receiver.

10. The electronic surveillance system of claim 9 wherein said second layer comprises a magnet for biasing said first layer.

* * * * *